US010151496B2

(12) United States Patent
Raggi et al.

(10) Patent No.: US 10,151,496 B2
(45) Date of Patent: Dec. 11, 2018

(54) ANTI-SPILL RECEPTACLE FOR DOOR LATCH

(71) Applicant: Electrolux Home Products, Inc., Charlotte, NC (US)

(72) Inventors: Tommaso Raggi, Forli (IT); Gabriele Gardini, Forli (IT); Andrea Creti, Forli (IT)

(73) Assignee: Electrolux Home Products, Inc., Charlotte, NC (US)

( * ) Notice: Subject to any disclaimer, the term of this patent is extended or adjusted under 35 U.S.C. 154(b) by 325 days.

(21) Appl. No.: 15/207,606

(22) Filed: Jul. 12, 2016

(65) Prior Publication Data

US 2018/0017267 A1 Jan. 18, 2018

(51) Int. Cl.

| | |
|---|---|
| ***F24C 15/14*** | (2006.01) |
| ***F24C 14/02*** | (2006.01) |
| ***F24C 15/02*** | (2006.01) |

(52) U.S. Cl.

CPC ..... *F24C 15/14* (2013.01); *F24C 14/02* (2013.01); *F24C 15/022* (2013.01)

(58) Field of Classification Search

CPC ..... F24C 14/02; F24C 15/14
USPC ..... 126/192, 190
See application file for complete search history.

(56) References Cited

U.S. PATENT DOCUMENTS

| | | | | |
|---|---|---|---|---|
| 2,725,454 | A | 11/1955 | Grant | |
| 6,060,700 | A | 5/2000 | Perlman | |
| 6,302,098 | B1 | 10/2001 | Smith | |
| 6,698,418 | B2 | 3/2004 | Ramsey | |
| 7,765,643 | B2 | 8/2010 | Vanini | |
| 8,028,619 | B2 * | 10/2011 | Lee | F24C 15/006 126/193 |
| 9,897,327 | B2 * | 2/2018 | Phillips | F24C 15/006 |
| 2007/0204847 | A1 * | 9/2007 | Lee | H05B 6/6414 126/200 |
| 2007/0267402 | A1 | 11/2007 | Harned | |
| 2011/0017191 | A1 * | 1/2011 | White | E05F 1/1261 126/198 |
| 2013/0000626 | A1 | 1/2013 | Trautner | |
| 2013/0319393 | A1 | 12/2013 | Harward et al. | |
| 2015/0308149 | A1 * | 10/2015 | Oshmyansky | A61L 2/0088 222/30 |

FOREIGN PATENT DOCUMENTS

| | | | | |
|---|---|---|---|---|
| WO | WO 2012089460 | A1 * | 7/2012 | F24C 15/14 |

* cited by examiner

*Primary Examiner* — Gregory Huson
*Assistant Examiner* — Nikhil Mashruwala
(74) *Attorney, Agent, or Firm* — Pearne & Gordon LLP

(57) ABSTRACT

A cooking appliance includes an oven cavity and a door for selectively opening and closing the oven cavity. The door includes an interior space and a latch opening defining a hole into the interior space. A spill receptacle is provided within the door and is aligned with the latch opening. The receptacle defines a compartment that is isolated from the interior space of the door and oriented to capture foreign items that penetrate the latch opening. In one example, a door latch is provided latch for locking the door in a closed position. The latch includes a hook member receivable through the latch opening when the door is in the closed position.

24 Claims, 11 Drawing Sheets

ANTI-SPILL RECEPTACLE FOR DOOR LATCH

CROSS-REFERENCE TO RELATED APPLICATIONS

Not applicable.

FIELD OF THE INVENTION

The present disclosure relates to cooking appliances, and more particularly, to an oven door having an anti-spill receptacle within the door that is aligned with a door latch opening.

BACKGROUND OF THE INVENTION

Ovens, such as a wall oven or freestanding range, have a hinged oven door that provides access to the oven or cooking cavity. Motorized self-cleaning oven door latches are well known in the art and typically include a rotary motor mounted at a rearward portion of the range body above the oven chamber and a reciprocating latch hook at a forward portion of the range body. The latch hook is engageable with a latch opening of the closed oven door.

A problem associated with the latch opening in the inner surface of an oven door is that solid food or liquids can enter the interior of the oven door through the latch opening. For example, liquids can be accidentally spilled into the latch opening when the door is open. Such liquids may stain the window glass of the oven door and/or cause unpleasant odors during cooking. It can be difficult to clean such liquids from the interior of the oven door, which may require disassembling the door.

BRIEF SUMMARY OF THE INVENTION

The following presents a simplified summary of example embodiments of the invention. This summary is not intended to identify critical elements or to delineate the scope of the invention.

In accordance with one aspect, a cooking appliance comprises an oven cavity and a door for selectively opening and closing the oven cavity. The door comprises an interior space and a latch opening defining a hole into the interior space. A spill receptacle is provided within the door and is aligned with the latch opening. The receptacle defines a compartment that is isolated from the interior space of the door and oriented to capture foreign items that penetrate the latch opening.

In accordance with another aspect, a cooking appliance comprises a housing comprising a pyrolytic self-cleaning oven cavity and a door attached to the housing for selectively opening and closing the oven cavity. The door comprises an outer surface and an inner surface, wherein the inner surface comprises a latch opening. A motorized oven door latch mechanism is provided for locking the oven door in a closed position, comprising a hook member receivable through the latch opening when the door is in the closed position. A spill receptacle is mounted within an interior space of the door between the outer and inner surfaces and is sealed to the inner surface about the latch opening to thereby capture foreign items that enter the interior space of the door via the latch opening.

It is to be understood that both the foregoing general description and the following detailed description present example and explanatory embodiments. The accompanying drawings are included to provide a further understanding of the described embodiments and are incorporated into and constitute a part of this specification. The drawings illustrate various example embodiments of the invention.

BRIEF DESCRIPTION OF THE DRAWINGS

The foregoing and other aspects will become apparent to those skilled in the art upon reading the following description with reference to the accompanying drawings, in which.

DESCRIPTION OF EXAMPLE EMBODIMENTS

Figure 1:
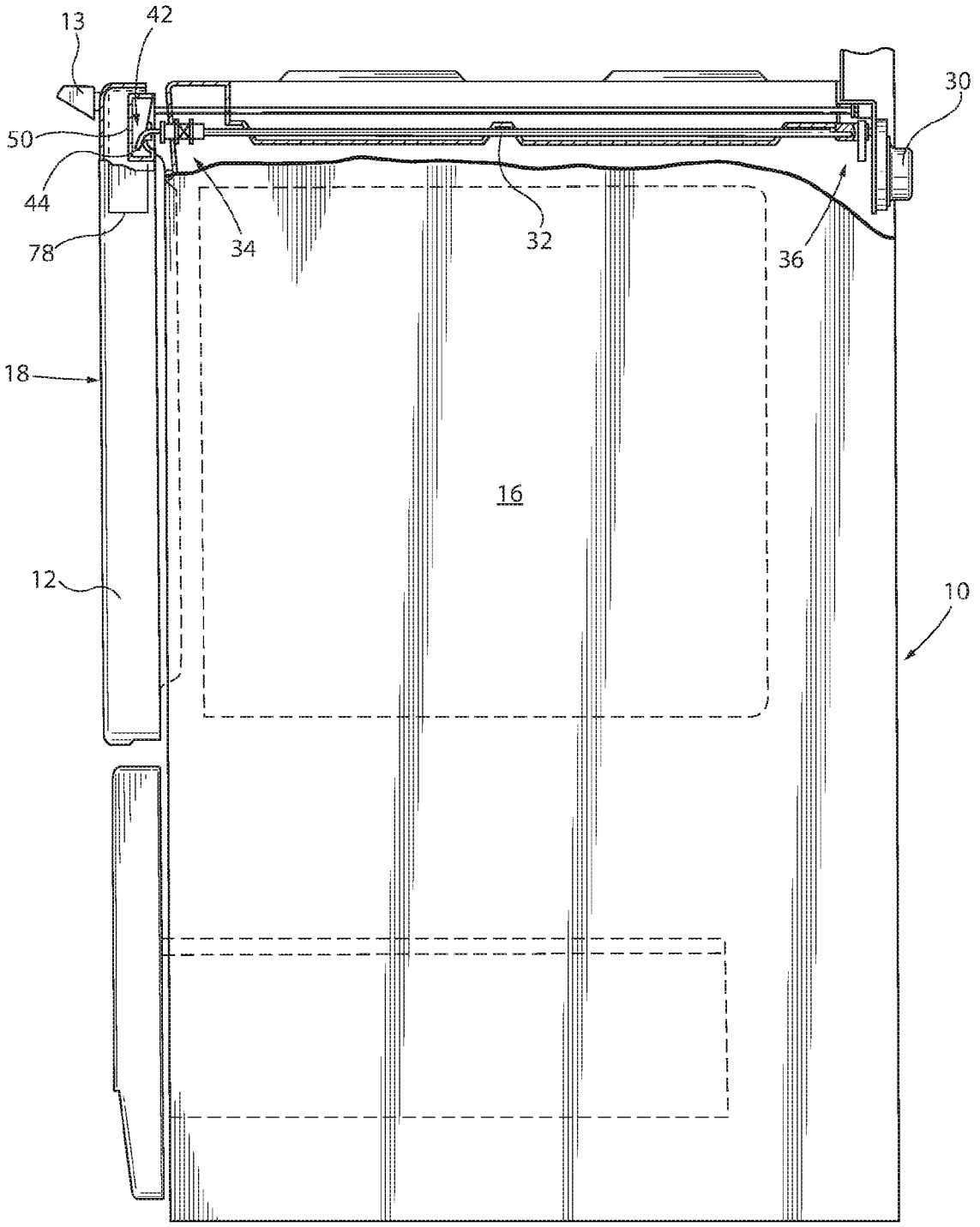
FIG. 1 illustrates a side view of a cooking appliance of the instant application.

Example embodiments are described and illustrated in the drawings. These illustrated examples are not intended to be a limitation on the present invention. For example, one or more aspects can be utilized in other embodiments and even other types of devices. Moreover, certain terminology is used herein for convenience only and is not to be taken as a limitation. Still further, in the drawings, the same reference numerals are employed for designating the same elements.

Turning to the shown example of FIG. 1, a cooking apparatus or appliance, such as a wall oven or freestanding range (hereinafter "oven") 10, is illustrated. The oven 10 has a door 12 attached to the housing 14 of the oven for selectively opening and closing an oven cavity 16. The door 12 is typically hinged at its lower edge to open forward, but it could be hinged at one of its vertical or side edges. The door 12 closes and opens to provide access to the oven cavity 16, and includes a handle 13 for operation by the user.

Figure 2:
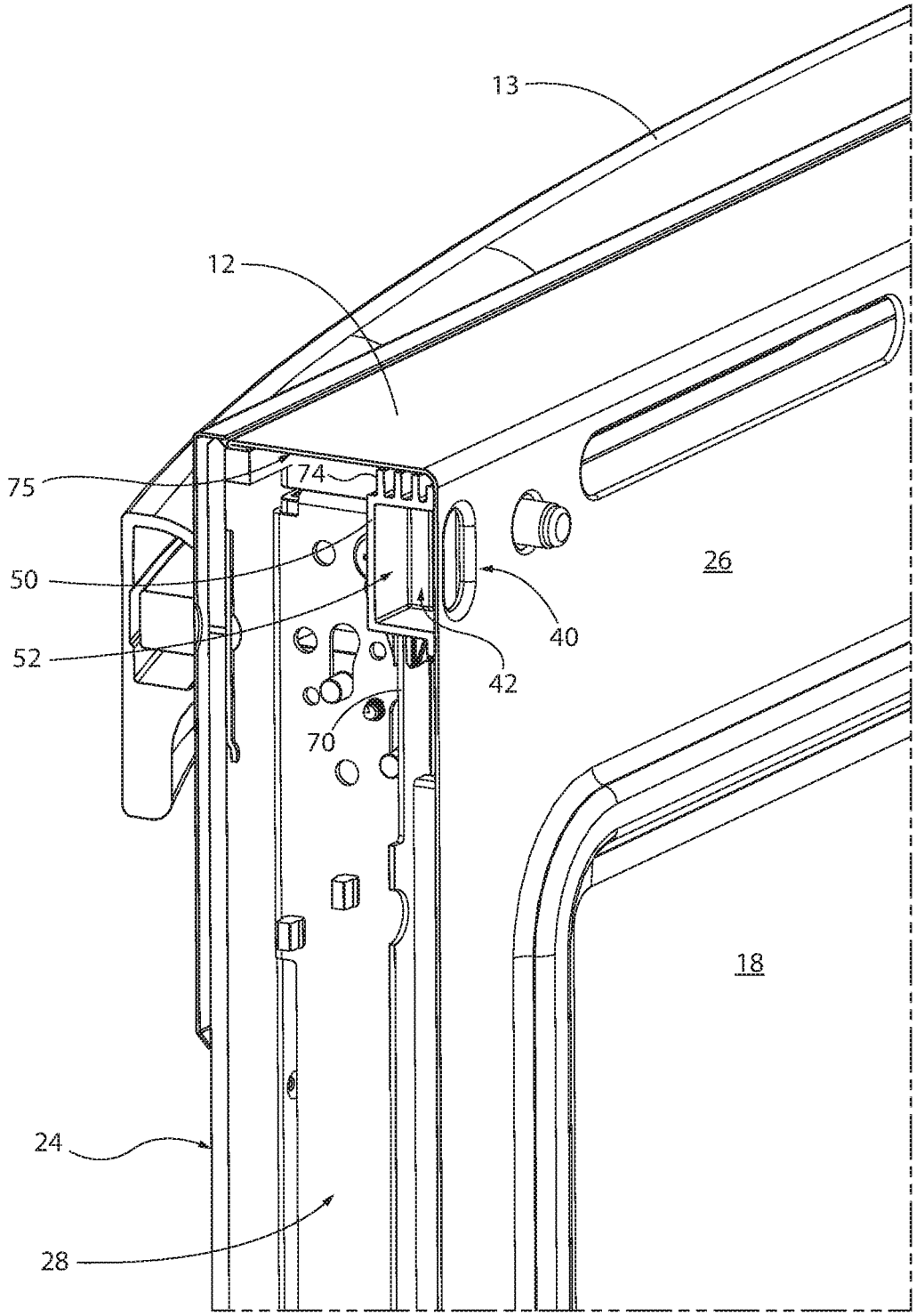
FIG. 2 illustrates a rear perspective, partial sectional view of an oven door of the cooking appliance.

As shown in FIG. 2, the door 12 can include a window 18 for allowing the oven cavity 16 to be viewed when the door 12 is in the closed position. The window can have an outer pane, an inner pane, and additional panes if desired. The door 12 has an outer surface 24 that faces forward toward the user when the door is in the closed position (and faces generally downward when the door is fully open). The door 12 further has an inner surface 26 that closes the oven cavity 16 when the door is in the closed position (and faces generally upward when the door 12 is fully open). The door 12 further includes an interior space 28 defined between the inner surface 26 and the outer surface 24 that may include one or more interior glass panes or other internal structural components. A latch opening 40 extends through the inner surface 26 and defines a hole into the interior space 28.

In a known manner, the oven cavity 16 can be highly heated to a temperature in excess of 750° F. (400° C.), wherein the walls of the oven chamber or cavity 16 are self-cleaned by pyrolytic action. During a self-cleaning cycle, the oven door 12 is locked to prevent the user from accessing the oven cavity 16. A latch mechanism is provided to lock the oven door 12 in its closed position as illustrated in FIG. 1.

The latch mechanism includes a door latch 42 for locking the door in a closed position. The latch 42 includes a hook member 44 receivable into the latch opening 40 when the door 12 is in the closed position. The latch mechanism further includes a rotary motor 30 including appropriate reduction gearing, if desired. The motor 30 can be located variously, although is typically located towards a rear of the oven 10. The motor 30 rotates an elongated latch rod 32 that extends through a portion of the range body, such as through an upper portion of the body as shown in FIG. 1. The rod 32 is generally of circular cross section and extends from the back portion of the range, where the motor 30 is mounted, to the forward portion of the range wherein the distal hook member 44 of the rod 32 can engage and disengage with the oven door 12 at the door latch 42. One end 34 of the rod 32 includes the hook member 44 extending generally radially away from a longitudinal axis of the latch rod 32, while an opposite end 36 of the latch rod 32 is rotatably driven by the motor 30.

Figure 3A:
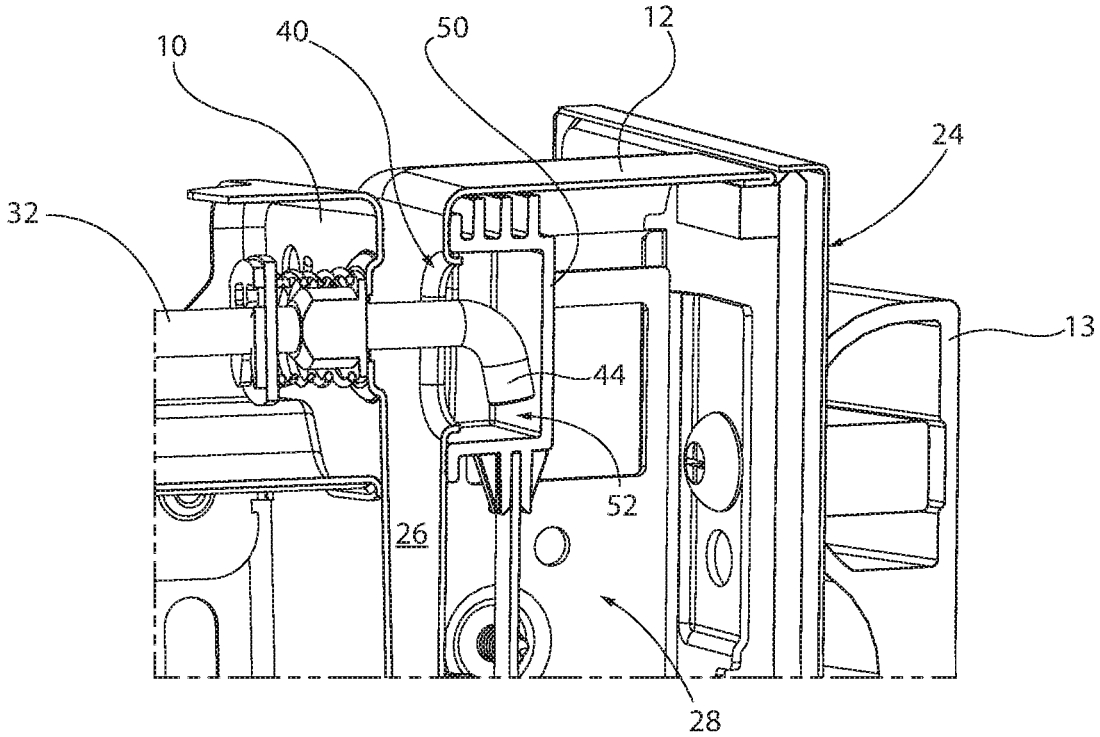
FIGS. 3A-3B illustrate detail, sectional views showing an example operation of a door latch.
Figure 3B:
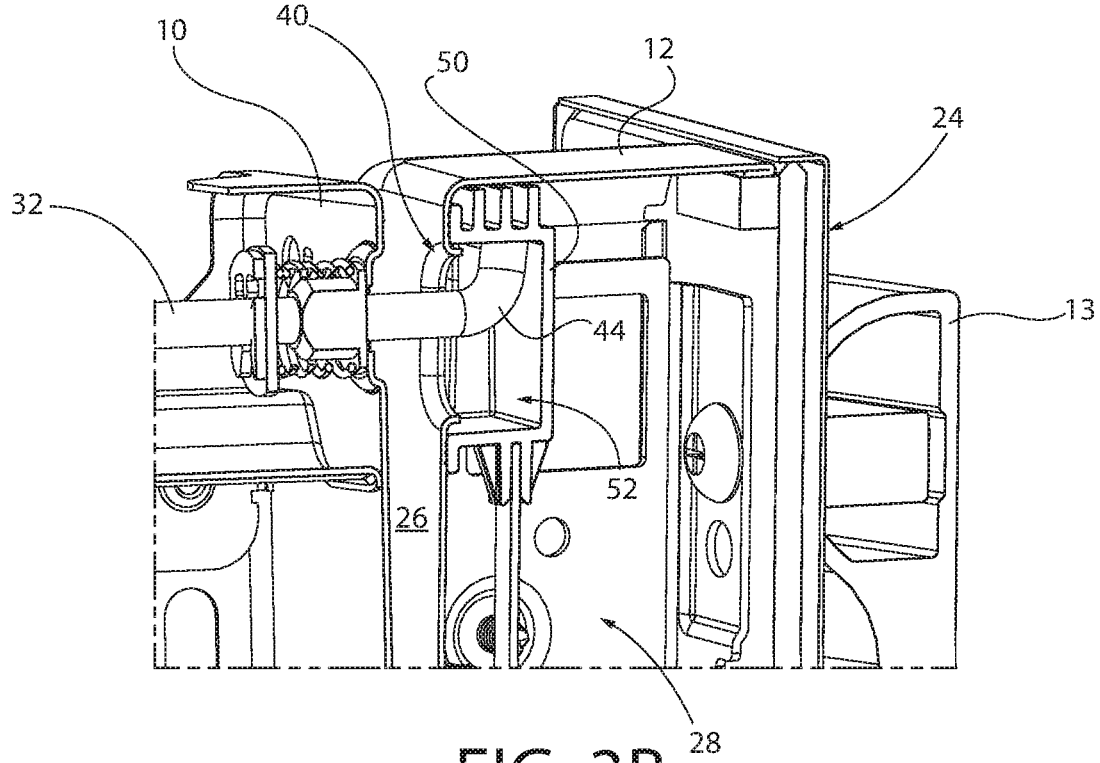

Turning now to FIGS. 3A-3B, operation of the latch mechanism is illustrated with the oven door 12 in the closed position. The latch opening 40 on the inner surface 26 of the oven door 12 is positioned so that, when the door is moved to the closed position, the latch opening 40 is aligned to receive the hook member 44. The latch opening 40 can have various geometries that correspond to the shape and size of the hook member 44. Preferably, the opening 40 has a non-uniform geometry, such as a generally oval or rectangular shape shown in FIG. 2, so that the hook member 44 when rotated to the locked position will impinge upon the sheet metal of the inner surface 26 of the oven door to prevent the hook member 44 from being passed through the latch opening 40. As shown in FIGS. 3A-3B, the longitudinal axis of the lock rod 32 is positioned to be off-center with respect to the center of the oval-shaped latch opening 40. In FIG. 3A, the door latch is in the unlocked position such that the hook member 44 is rotatably positioned to pass through the latch opening 40. In FIG. 3B, the door latch is in the locked position whereby the latch rod 32 has been rotated by the motor 30 so that the hook member 44 is rotatably positioned to be prevented from passing through the latch opening 40 and preventing the oven door from being opened. The locked position can occur by rotating the hook member 44 through various amounts of predetermined angular rotation within the range of 180 degrees between locked and unlocked positions. Preferably, the hook member 44 rotates through an angle of at least 45 degrees, and may rotate at least 90 degrees, at least 135 degrees, at least 180 degrees, at least 360 degrees, or to any amount within that range.

Figure 4:
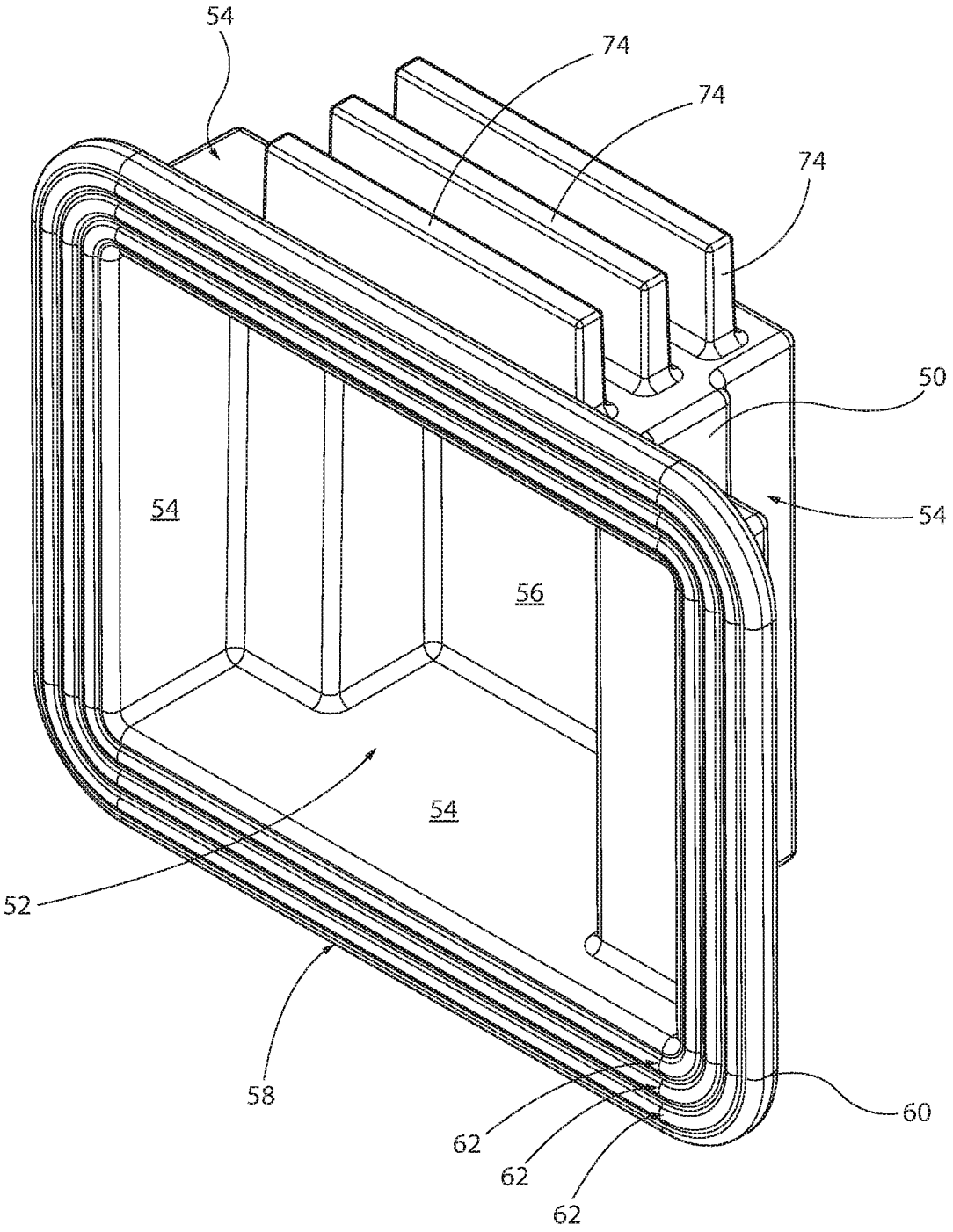
FIG. 4 illustrates a perspective view of an example spill receptacle.

As discussed above, one problem associated with the latch opening 40 on the inner surface 26 of the door 12 is that food or liquids can enter the interior space 28 of the oven door through the latch opening 40, due to an accidental spill for example. Such food or liquids may stain the glass panes of the oven door 12 and/or cause unpleasant odors during cooking, and it can be difficult to clean food or liquid from the interior of the oven door 12. In order to avoid this problem, a spill receptacle 50 is provided within the oven door 12 that is aligned with the latch opening 40. As shown in FIGS. 2-4, the spill receptacle 50 defines a compartment 52 that is isolated from the interior space 28 of the door 12 and oriented to capture foreign items (i.e., spilled food or liquid, etc.) that penetrate the latch opening 40. The compartment 52 of the spill receptacle 50 can be at least partially, and preferably completely, isolated from the interior space 28. Most preferably, the compartment 52 encapsulates the area within the interior space 28 that is immediately adjacent the latch opening 40 so that any foreign items that penetrate into the door are thereby captured within the spill receptacle 50.

The compartment 52 is defined by a plurality of side walls 54, a rear wall 56, and an open front opening 58. The walls of the compartment are connected together to form a unitary body, and preferably a monolithic body. Still, it is contemplated that one or more of the walls could be pivotable or even removable relative to the other walls to thereby permit a user to empty the captured foreign items therefrom. In addition or alternatively, a drain hole could be provided that is connected to another container or drain hose, etc. for removing captured material. The front opening 58 abuts the inner surface 26 of the oven door 12, and the hook member 44 of the latch rod 32 is insertable into the compartment 52 through the front opening 58. The compartment 52 is large enough to permit the hook member 44 to rotate therein through an angle of at least 45° between locked and unlocked positions. Most preferably, the compartment 52 is large enough to permit the hook member 44 to rotate therein through any angle within the range of at least 45° to at least 180°, and preferably to at least 360°. The compartment 52 can be suitably designed to permit such rotation.

The spill receptacle 50 comprises a flange 60 extending about a periphery of the front opening 58 that abuts the inner surface 26 of the oven door 12. A face surface of the flange 60 comprises a face seal with at least one and preferably a plurality of grooves 62 configured to seal against the inner surface 26 of the door. As shown in FIG. 4, the grooves 62 preferably extend along the face surface around the entire perimeter of the flange 60 and are arranged in a stacked array or pattern so as to provide multiple seal points along each side edge. It is contemplated that the grooves 62 may extend about less than the entire perimeter, provided that a sufficient seal exists to inhibit leakage of the foreign items into the interior space 28 of the door 12. In this manner, the spill receptacle 50 is substantially sealed against the inner surface 26 so as to prevent leakage of the foreign items captured therein, especially liquids and the like. The grooves 62 of the face seal can maintain the sealed condition via a compression seal against the inner surface 26. In addition or alternatively, a sealant or the like (not shown) could be applied between the face surface of the flange 60 and the inner surface 26 of the door.

Along these lines, the spill receptacle 50 is preferably made of a plastic or other partially flexible material (silicone, rubber, or similar) whereby the grooves 62 can maintain the compression seal against the door. Alternatively, the spill receptacle 50 could be manufactured of a substantially rigid material (plastic, metal, hard rubber, etc.) and the grooves 62 of the face seal could be overmolded or otherwise connected with a relatively softer and/or more flexible material (plastic, rubber, silicone, etc.) suitable for maintaining a compression seal. The spill receptacle 50 is preferably manufactured of a material that is nonreactive with the foreign items expected to be contained therein. Additionally, the temperature is usually high in the area where the door latch engages the door's structure, so the spill receptacle's material is intended to withstand high temperatures. Thus, the spill receptacle 50 is preferably manufactured of a material that can be elastically deformed when mounted within the interior space of the door and is capable of withstanding a temperature of at least 750° F. (400° C.) so as to be suitable for use in a pyrolytic self-cleaning oven.

Figure 5:
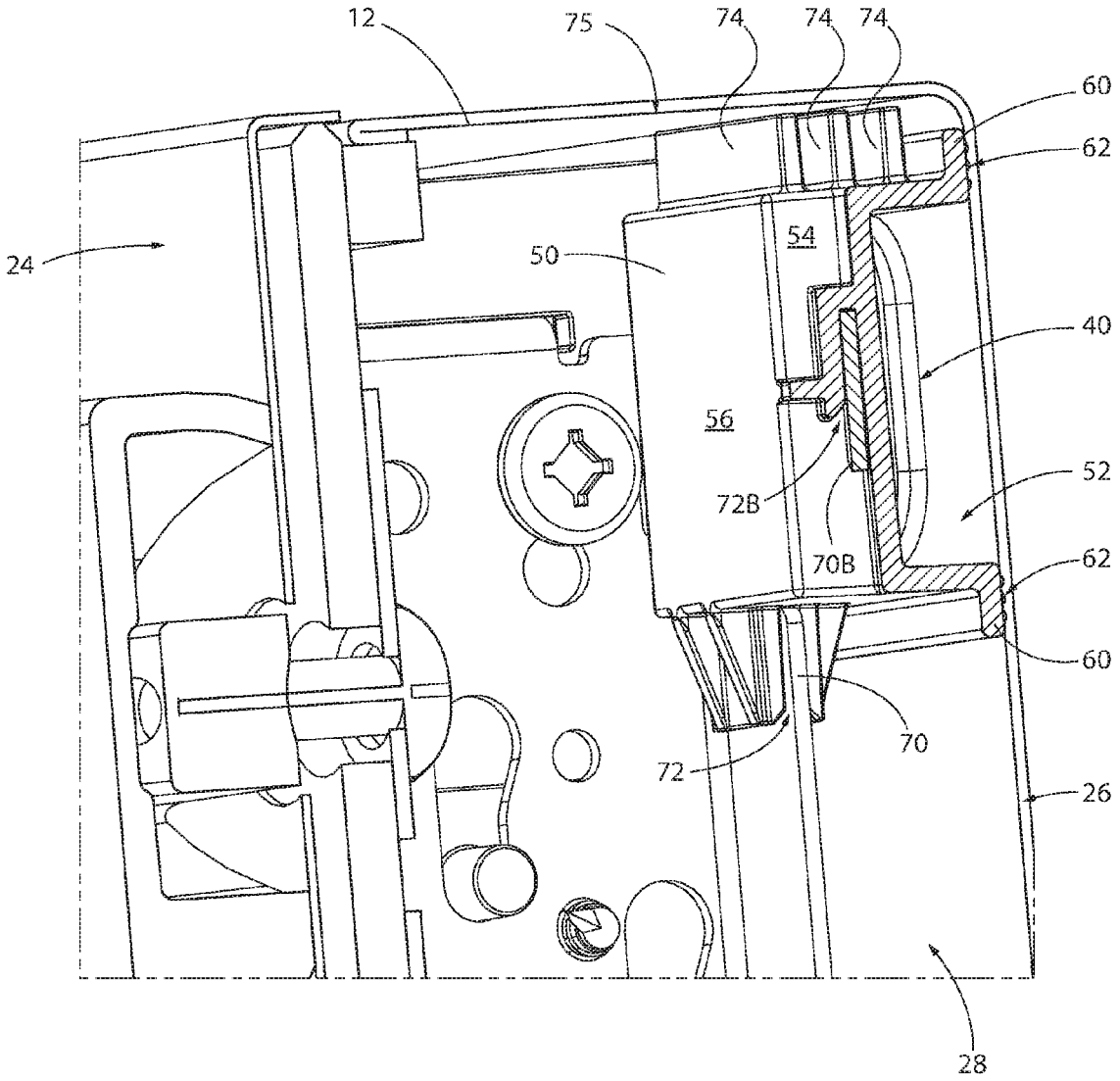
FIG. 5 illustrates a perspective, partial sectional view of an interior space of the oven door with the spill receptacle installed.

The spill receptacle 50 can be mounted within the interior space 28 of the door 12 in various manners. In one example, the spill receptacle 50 can be secured within the inner surface 26 by an adhesive or welding operation. In another example, the spill receptacle 50 can be secured via one or more removable mechanical fasteners. Turning to the example shown in FIG. 5, the spill receptacle 50 can be secured via a bracket 70 located within the inner surface 26. An exterior surface of the spill receptacle 50 includes structure for connecting to the bracket 70, including an aperture, hole, or the like. In one example, a slot 72 receives the bracket 70 to thereby mount the spill receptacle 50 within the door 12. The slot 72 can be provided by a pair of spaced apart projections extending outward from the exterior surface of the spill receptacle 50. Preferably, the slot 72 has a width substantially similar to the thickness of the bracket 70, and preferably has a slightly smaller width to provide a snug interference fit. Any exterior surface of the spill receptacle 50 can include the slot 72, and is contemplated that multiple slots can be provided on different exterior surfaces for engagement with multiple brackets. In the shown example of FIG. 5, the slot 72 is provided on a bottom wall of the spill receptacle 50 to mate with an upstanding bracket 70 located within the door 12. In this manner, the bracket 70 supports the spill receptacle 50 against the force of gravity and provides a simple and easy mechanism for locating the spill receptacle 50 within the door during the assembly process at the manufacturing facility. It is further contemplated that some other structure can be provided for coupling the spill receptacle 50 to the bracket 70, such as mechanical fasteners, snap-in connection, adhesives, welding, etc.

In order to further locate and retain the spill receptacle 50 within the door, the spill receptacle 50 can be constrained in the vertical direction to prevent it from detaching when the door is open and closed or during the appliance use and transportation. An exterior surface of the spill receptacle 50 can include at least one and preferably a plurality of projections 74 extending outwards to engage a portion of an inner surface of the door that is spaced apart from the latch opening 40. In the shown example of FIG. 5, the plurality of projections 74 extend upwards from a top wall of the spill receptacle 50 contact against the top wall 75 of the oven door 12. It is preferred that the plurality of projections 74 are at least somewhat flexible so as to provide a snug fit against the top wall 75 to thereby provide a positive location feature that aligns the compartment 52 with the latch opening 40 during the manufacturing process. In one example, the distance between the bottom of the slot 72 and the top of the projection 74 is substantially the same or even slightly smaller than the distance between the end of the bracket 70 and the top wall 75 of the door 12. Preferably, the spill receptacle 50 avoids noise generation/rattling due to vibration or contact with other components. For this reason, the proposed material of at least the projections 74, and possibly the entire spill receptacle 50, is relatively soft and can be deformed under low loads.

It is further contemplated that more than one bracket and slot combination can be used to retain the spill receptacle. For example, as shown in partial sectional view in FIG. 5, a secondary bracket 70B be could be retained within a secondary slot 72B on another side of the spill receptacle 50, such as one of the lateral sides. The use of two brackets/slots positioned at different axes can be useful to maintain a secure connection and consistent alignment of the spill receptacle 50 within the door 12.

The spill receptacle 50 may not be emptied by the user, or alternatively, may be provided with suitable structure to periodically permit a partial or complete cleanout. In order to permit a user to empty the foreign items captured within the spill receptacle 50, the oven door 12 can optionally include a removable access panel 78 covering an access hole into the interior space 28 (see FIG. 1). The spill receptacle 50 maybe permanently mounted within the oven door 12, or may even be removable therefrom for cleaning. If permanently mounted, one or more walls of the spill receptacle 50 could be pivotable or even removable to provide access to the captured foreign items when the access panel 78 is opened or removed. Alternatively, the spill receptacle 50 could be selectively removable, partially or completely, from the door 12 via the access hole when the removable access panel 78 is opened or removed from the door. It is further contemplated that the oven could include a sensor or other lockout feature that would inhibit operation of the oven when the spill receptacle 50 was removed, and/or the removable access panel 78 was in an open or removed condition.

Figure 6:
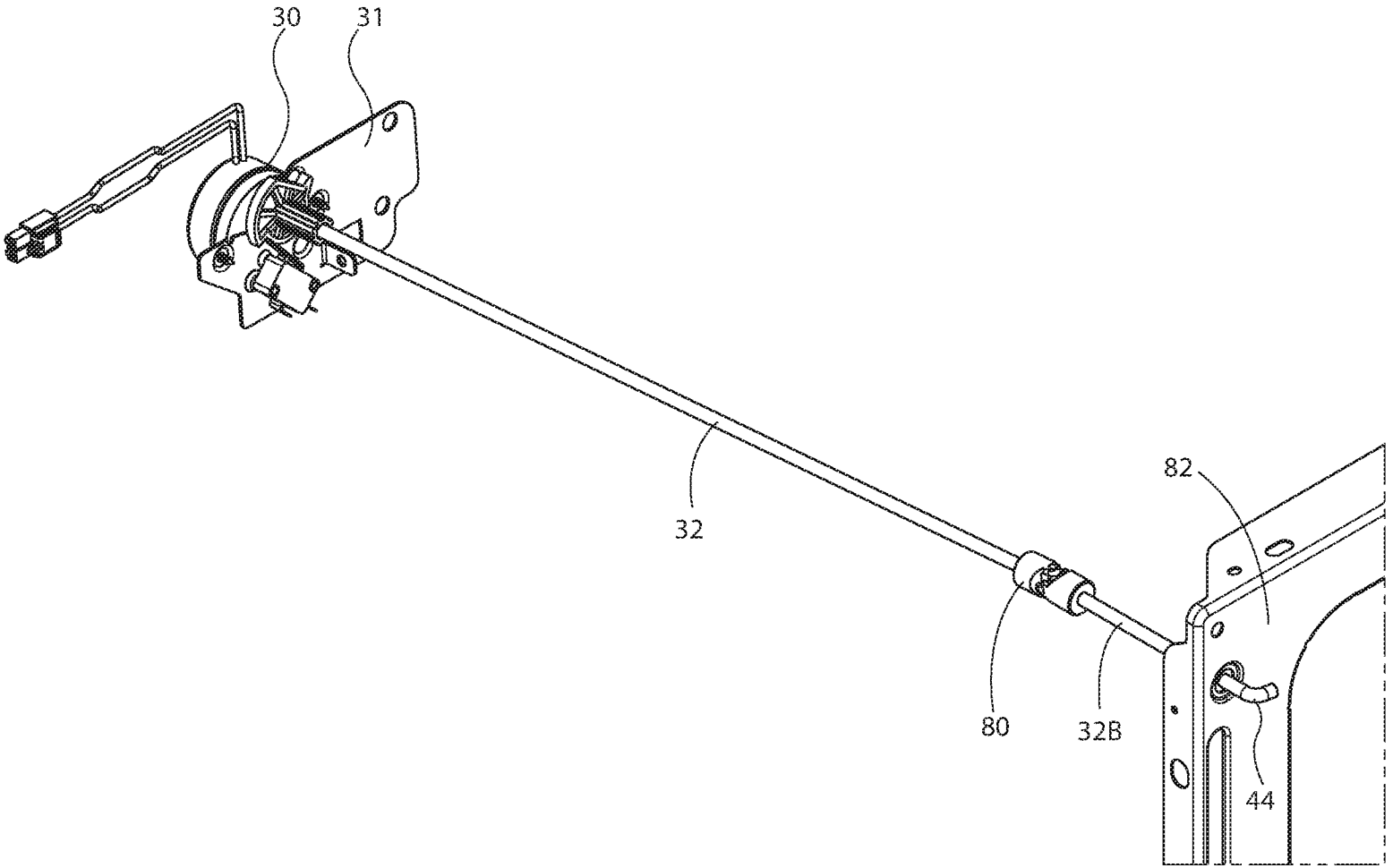
FIG. 6 illustrates a perspective view of a motorized door latch.
Figure 7:
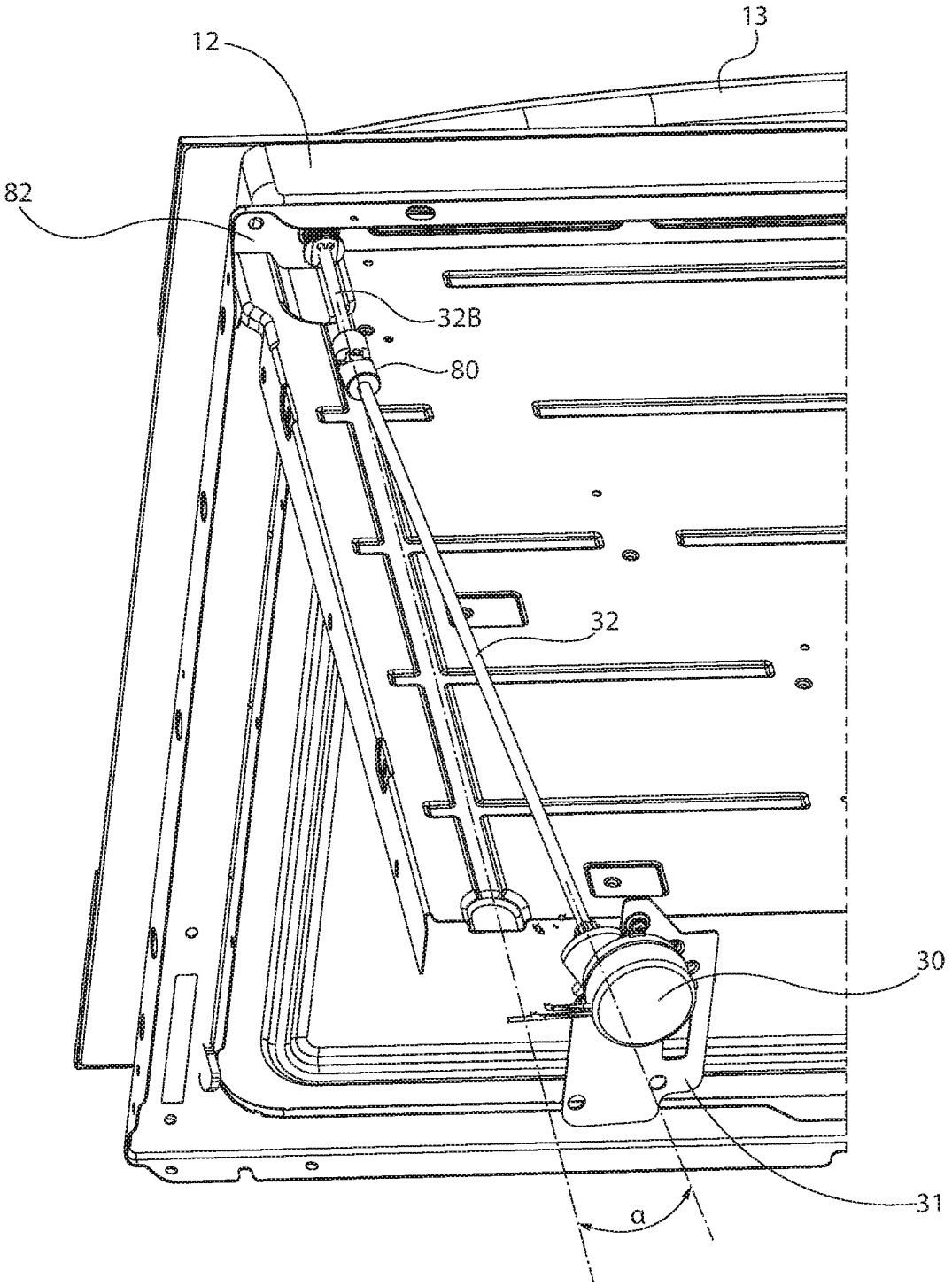
FIG. 7 illustrates a perspective view of a multi-part latch rod.

Turning now to FIGS. 6-7, there is illustrated in greater detail a system for rotationally driving the latch rod 32. The motor 30, which can include appropriate reduction gearing of a conventional nature, is fixed to a motor support member or plate 31, which in turn is solidly fastened to a rigid structural support portion of the range body. The motor 30 is preferably mounted as illustrated to the back portion of the plate 31, which has an aperture through which a motor drive shaft extends for connection to the latch rod 32. As also shown in FIG. 1, the latch rod 32 extends forwardly towards the front side of the oven such that the distal hook member 44 projects outwardly for engagement with the latch opening 40 of the door. Conventionally, the latch rod 32 is a one-piece, solid straight rod that restricts positioning of the motor 30 to be only in a very limited area, due to the positioning of the hook member 44. Essentially, the latch opening 40 and the motor mounting area had to lie on a straight line.

By the present application, the modified latch rod herein includes a first rod 32 connected to a rotary electrical motor 30 located in a rearward portion of the cooking appliance, and a separate, second rod 32B connected to or formed with a hook member 44 configured to engage the latch opening 40 of the door, thereby locking the door in a closed position. A rod joint system 80 enables these two rods 32, 32B to be connected together end-to-end by a joint that permits rotation, such as a universal joint, a flexible joint, or any other kind of joint, to transmit rotation of one of the rods to the adjoining rod. The rod joint system could further make the connection between the two adjacent rods by using a parallel axis distributor system or the like, in which the motor input axis is separated a distance from a door latch rod output axis by intermediate gearing and the like.

As shown in FIG. 7, the second rod 32B connected to or formed with the hook member 44 can be perpendicular to both the oven front frame 82 and the oven door 12, for example coaxial with an axis of rotation of the hook member when rotated between its locked and unlocked positions. The other rod 32 (which is connected to the motor) is mounted, via the rod joint system 80, at an angle $\alpha$ relative to the second rod 32B which is based on the lateral and vertical positioning of the motor 30 relative to the location of the latch and the distance between them front-to-rear. The angle α can be 0° or any angle up to 90°, or even more, depending upon the operational ability of the rod joint system 80. Although the angle α is shown variable along one axis, it is understood that the rod joint system 80 can permit a variable angle along multiple axes to provide a large amount of design variation for the positioning of the motor 30 and associated structure. This mechanism allows the motor to be positioned in a wide area range without affecting the location and operation of the latch itself, providing greater design freedom. One or more brackets may be used to support the rod in order to avoid rod deflection or instability caused by the joint.

Several advantages are provided by this design. In particular, the use of a rod joint system 80 provides flexibility of mounting areas of latching motor, and does not substantially change the door or oven structure or assembly process. The modified latch rod allows the usage of the same latching system on different doors, only with small variants. Without this system, a door structure change can involve a complete redesign of the latching system (e.g.: motor mounting plate) and often the position of related micro-switches and cams, etc. It is contemplated that this rod joint system 80 can be utilized with any oven having a door latch system, either with or without the spill receptacle 50 described herein.

Turning now to FIGS. 8-11, there is illustrated in greater detail a modular hinge adapter utilized to connect the oven door 12 to the oven body by different possible hinge assemblies. Although described with reference to an oven, it is contemplated that the following feature is applicable to various types of appliances with hinged doors. Conventionally, a pair of hinge assemblies is utilized and spaced apart by a width that corresponds generally to a width of the oven door 12. There are two main places where door hinges are positioned in ovens: inside the range structure (body-mounted, with the hinge assembly inside the range structure) or inside the door (door-mounted, with the hinge assembly inside the door structure). Access to the oven cavity 16 is selectively permitted by opening and closing hinge-mounted oven door 12 swingable from a vertical closed position to an open horizontal position (rotated downward for opening and rotated upward for closing, or vice-versa).

Figure 8:
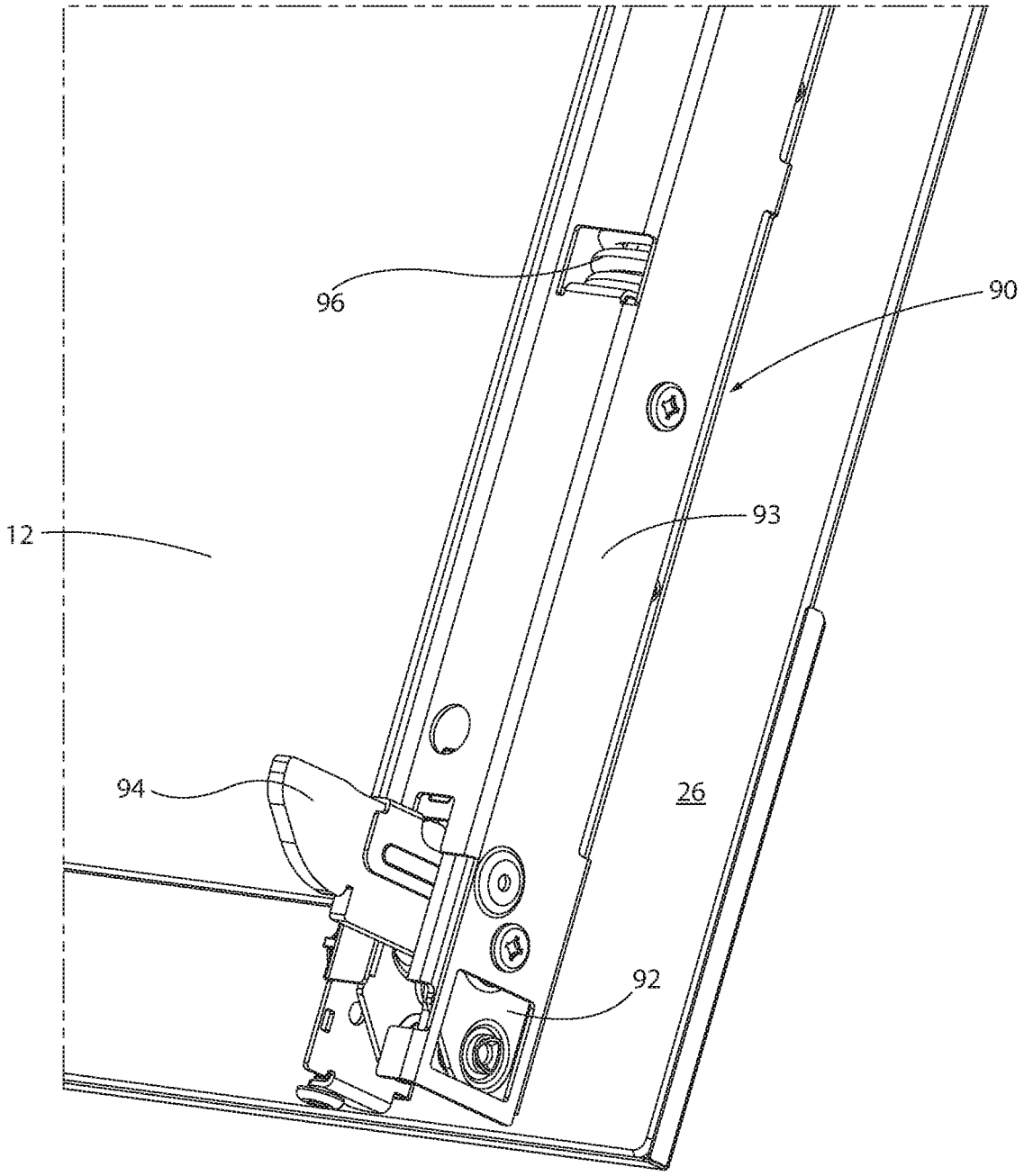
FIG. 8 illustrates an example door-mounted hinge.

As shown in FIG. 8, a conventional door-mounted hinge assembly 90 (only one shown) is coupled to a front portion of the oven door 12 (e.g., the inner surface 26 of the oven door or even within the interior space 28). The hinge assembly 90 includes a support member 92 that generally houses and/or supports various components of the hinge assembly 90 and is secured within a hollow mounting bracket 93 secured to the oven door and having a generally u-shaped or square/rectangular internal cross-section. The support member 92 is sized to provide a secure connection between the oven door 12 and the oven body (e.g., to endure repeated loading from opening/closing of the oven door). An elongate lever member 94 is secured to the oven body, and the support member 92 is rotatable relative thereto during opening/closing of the oven door 12. In a closed state of the oven door, the lever member 94 and the oven door 12 form an angle of about 90°. In an open state of the oven door, the lever member 94 and the oven door 12 form an angle between about 170° and 180°. A biasing member 96 is coupled to the support member 92 and structured to bias the support member 92 toward a first operative position, such as to automatically close or otherwise position the appliance door, when attached to the appliance. The biasing member 96 can be located inside or maintained external to the support member 92. As shown, the biasing member 96 can be a tension coil spring of metal wire; however other types of springs, such as compression springs, leaf springs, and materials, such as polymeric materials, can be employed.

However, conventionally it was not possible to have the same door structure for use with both a body-mounted hinge and a door-mounted hinge. Thus, a modular hinge adapter 100 is provided that creates a modular system and allows the usage of different kind of hinges with the same door, only by adding an additional part. The modular hinge adapter 100 is a structural add-on that converts a door-mounted hinge solution into a body-mounted hinge solution, thereby providing the flexibility of using the same door structure for both door-mounted and body-mounted hinges. The modular hinge adapter 100 allows the same side trim that ordinarily accommodates a door-mounted hinge to instead support a body-mounted hinge. As will be discussed below, a mating portion of the body-mounted hinge protrudes outward and can be received within the modular hinge adaptor that has been installed in the oven door, thereby coupling the mating portions of the body-mounted hinge and the modular hinge adapter.

Figure 9:
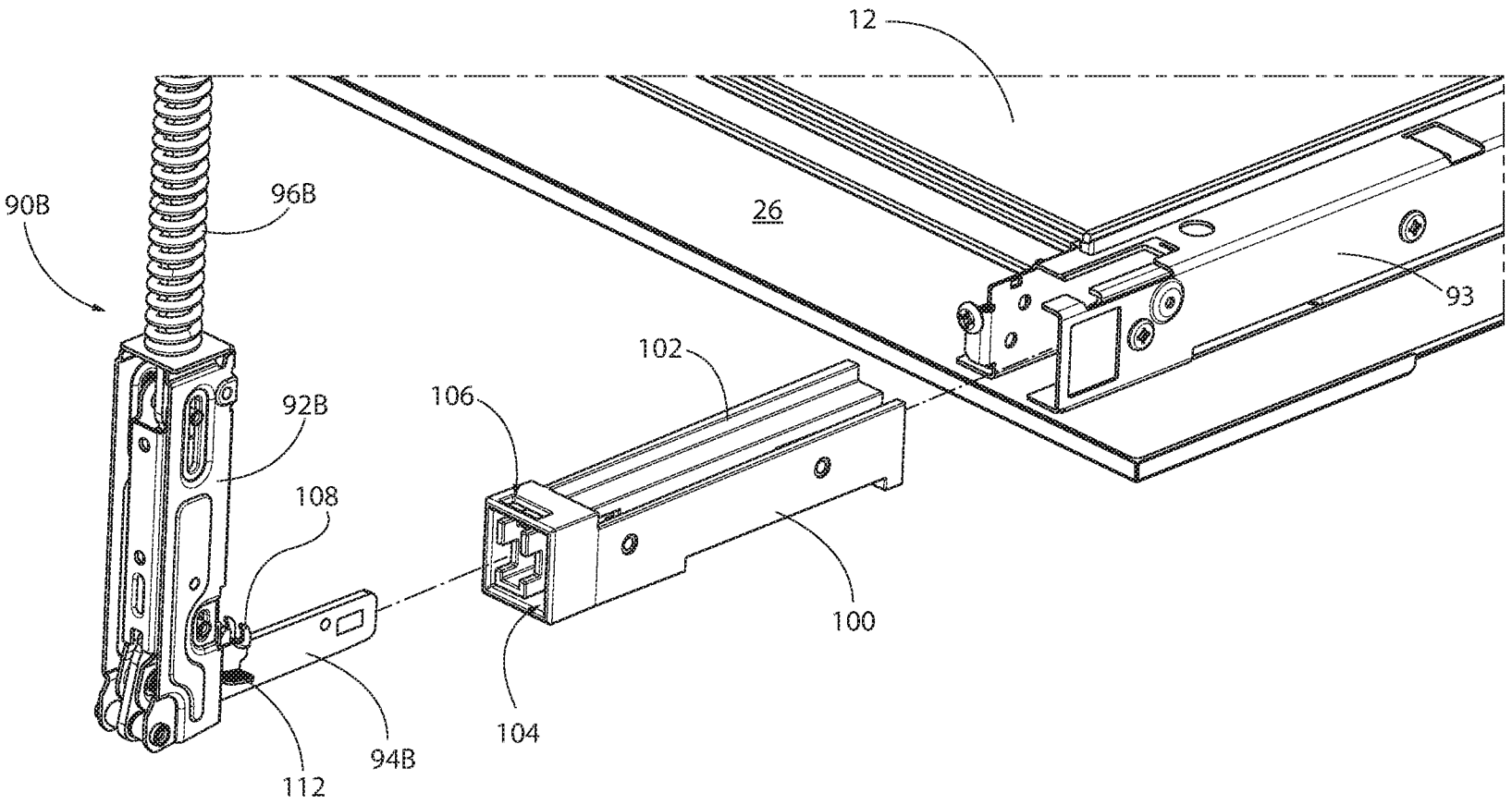
FIG. 9 illustrates an example hinge adapter for use with a body-mounted hinge.
Figure 10:
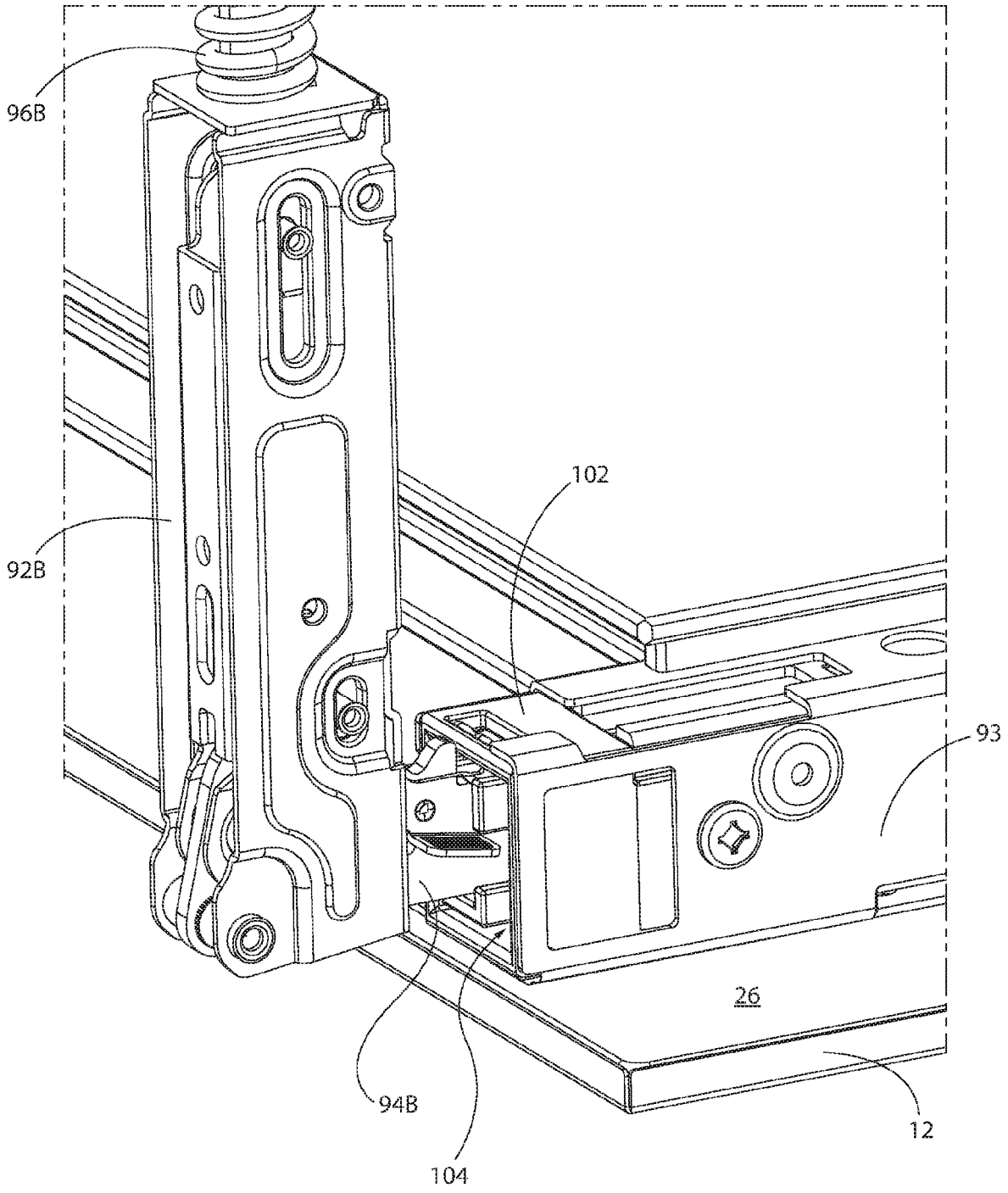
FIGS. 10-11 illustrate detail views of the hinge adapter and body-mounted hinge.
Figure 11:
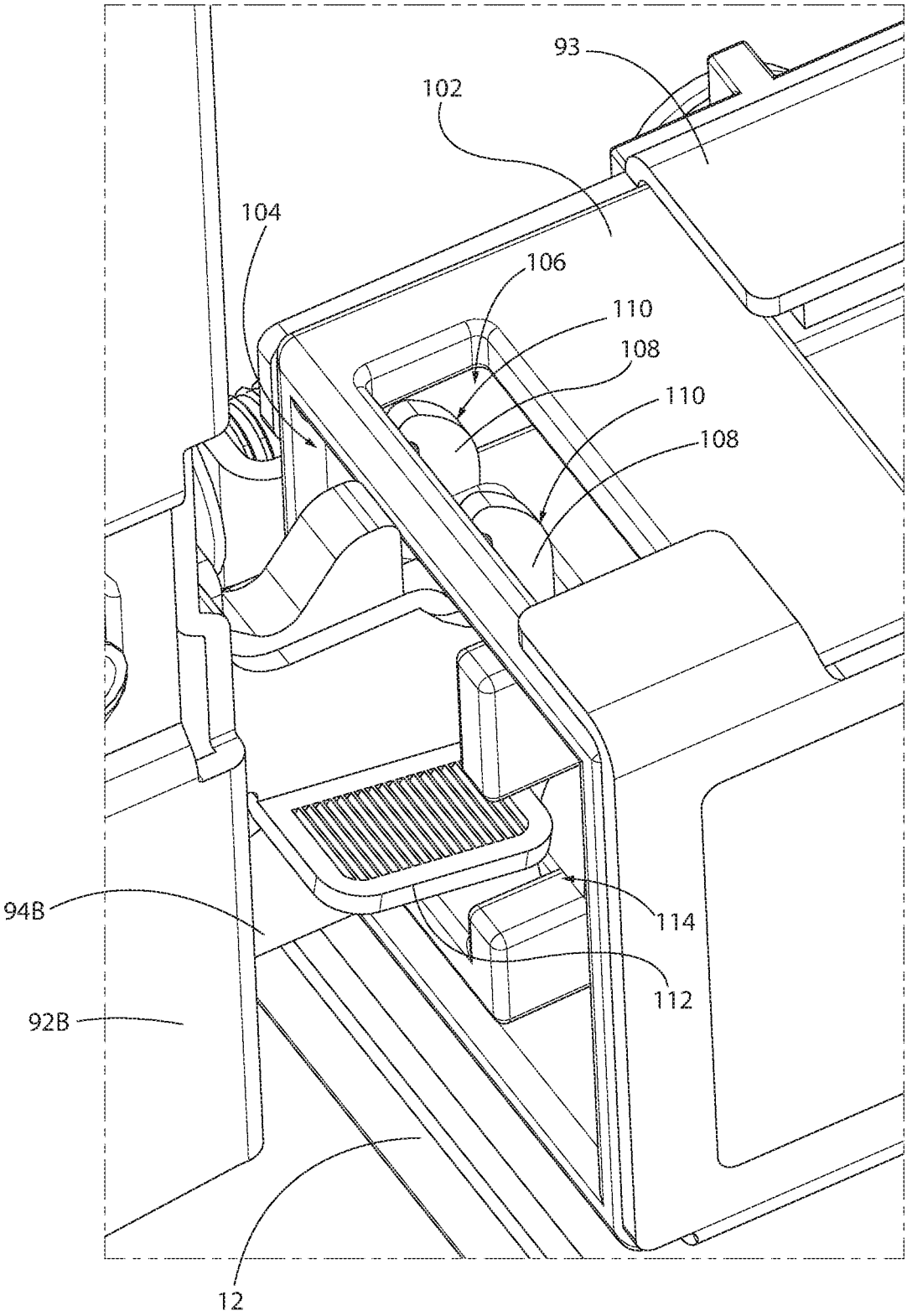

FIG. 8 shows a door side trim (i.e., hollow mounting bracket 93) designed to accommodate a door-mounted hinge 90, wherein the door-mounted hinge is installed. FIGS. 9-10 shows the same side trim (i.e., the same hollow mounting bracket 93), but with the door-mounted hinge removed and the modular hinge adapter 100 inserted in its place in the same cavity inside the side trim, thus allowing the same side trim to accommodate a body-mounted hinge assembly 90B. It is understood that the structural and operational components of the body-mounted hinge 90B (support member 92B, lever member 94B, biasing member 96B) are generally similar to those of the door-mounted hinge 90, although some variation may occur.

As illustrated in FIG. 9, the hinge adapter 100 includes an elongated body 102 that can be mounted inside the hollow mounting bracket 93 (side trim) or another hollow structural component of the oven door structure that typically accommodates a door-mounted hinge. The hinge adapter 100 is made of a rigid material, such as metal or plastic, suitable to withstand repeated mechanical loads of the oven door opening/closing. Preferably, the hinge adapter 100 has dimensions and shape complementary to the dimensions and shape of the interior of the hollow mounting bracket 93 or other hollow structural component of the oven door that accommodates the hinge. Screw holes may be formed on the side walls of the elongated body 102 of the hinge adapter 100. Initially, the modular hinge adapter can be positioned inside the hollow mounting bracket 93 (side trim) or other suitable cavity in the oven door by means of ribs or other positioning components. After the hinge adapter 100 is positioned inside the side trim, the hinge adapter can be fastened to the mounting bracket 93 by using screws or other means, such as snap-ins.

When installed, the elongated body 102 includes an open end 104 that faces the bottom of the oven door to receive the lever member 94B of the body-mounted hinge 90B within the elongated body 102. Adjacent the end 104 is an exposed, accessible hollow opening 106 or recess that is shaped to accommodate and fixedly engage with a locking member 108 of the body-mounted hinge 90B. In the shown example of FIGS. 10-11, the locking member 108 can include a claw portion or similar. A pair of claws are illustrated which engage the end 104 of the body 102 about the hollow opening 106, such as at an end bar partly defined by the opening 106, although one or more claws can be used. Preferably, the locking member 108 is resiliently biased to the locking condition (e.g., biased upwards in the shown illustration) by a spring or the like (not shown). The locking member 108 is positioned adjacent the lever member 94B, and preferably includes a cam structure 110 or the like that automatically engage the claws with the end 104 of the body 102 when the lever member 94B is properly inserted into the hinge adapter 100. Once the locking member 108 is engaged, the hinge assembly 90B is thereby secured to the oven door 12 via the hinge adapter 100. In order to remove the hinge assembly 90B, the locking member 108 can further include an unlocking lever 112 or the like that can be operated by a tool or the hand of a user to thereby disengage the locking member 108 from the end 104 of the modular adapter 100. As shown, the unlocking lever 112 is pressed downward to cause the claws to disengage from the hollow opening 106 of the end 104, whereupon the lever member 94B can be removed from the modular adapter 100. The end 104 can include recesses 114 or other clearance for the unlocking lever 112.

The hinge adapter 100 provides several benefits and variations. The hinge adapter 100 can be bigger or smaller, suitable for any kind of side trims or metal structural part of the door. One single adapter can fit different side trims, by having them designed so that the interfacing area on different side trims matches the same hinge adapter, hence using the same body-mounted hinge with different side trims. The hinge adapter can be design so that it can accommodates different body-mounted hinges, so that it gives flexibility to the same door structure to use different hinges. The hinge adapter can be made of different materials or combinations of different materials. With a co-injection molding process, the adapter structure can be reinforced with metal components, and/or the screws holes can be reinforced.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A cooking appliance, comprising:

an oven cavity;

a door for selectively opening and closing the oven cavity, the door comprising an interior space and a latch opening defining a hole into the interior space; and a spill receptacle within the door and sealed to an inner surface thereof about the latch opening, said receptacle defining a compartment that is isolated from the interior space of the door and oriented to capture foreign items that penetrate the latch opening, said spill receptacle comprising a material that is effective to withstand a temperature of at least 750° F.

2. The cooking appliance of claim 1, further comprising a door latch for locking the door in a closed position, said latch comprising a hook member receivable through the latch opening when the door is in the closed position.

3. The cooking appliance of claim 2, wherein the compartment is sufficiently large to permit the hook member to rotate therein through an angle of at least 45° between locked and unlocked positions.

4. The cooking appliance of claim 2, wherein the compartment is defined by a plurality of side walls, a rear wall, and a front opening, and the hook member is insertable into the compartment through front opening.

5. The cooking appliance of claim 4, wherein the spill receptacle comprises a flange extending about a periphery of the front opening that abuts the inner surface of the door.

6. The cooking appliance of claim 5, wherein a face surface of the flange comprises a face seal with a plurality of grooves configured to seal against the inner surface of the door.

7. The cooking appliance of claim 1, wherein an exterior surface of the spill receptacle comprises a plurality of projections extending outwards to engage a portion of the inner surface of the door.

8. The cooking appliance of claim 1, wherein the door comprises a bracket located within the interior space of the door, and an exterior surface of the spill receptacle comprises a slot to receive the bracket to mount the spill receptacle within the door.

9. The cooking appliance of claim 1, wherein the spill receptacle comprises a material that can be elastically deformed when mounted within the interior space of the door.

10. The cooking appliance of claim 1, further comprising an elongated latch rod having a hook member at one end extending generally radially away from a longitudinal axis of the latch rod, and an opposite end of the latch rod is rotatably driven by a motor.

11. The cooking appliance of claim 10, wherein the elongated latch rod comprises at least two separate rods that are connected to each other at a joint that permits said at least two separate rods to be angularly offset.

12. The cooking appliance of claim 1, wherein the door comprises a removable access panel covering an access hole into the interior space, and the spill receptacle is selectively removable from the door via the access hole when the removable access panel is removed from the door.

13. The cooking appliance of claim 1, wherein the cooking appliance further comprises a body-mounted hinge that interconnects a housing containing the oven cavity to the door and thereby pivotally supports the door for selectively opening and closing the oven cavity, and wherein the door further comprises a hollow mounting bracket and a hinge adapter configured to be securely mounted within the hollow mounting bracket to lockingly connect said body-mounted hinge to the hollow mounting bracket.

14. A cooking appliance, comprising:

a housing comprising a pyrolytic self-cleaning oven cavity;

a door attached to the housing for selectively opening and closing the oven cavity, the door comprising an outer surface and an inner surface, wherein the inner surface comprises a latch opening;

a motorized oven door latch mechanism for locking the oven door in a closed position, comprising a hook member receivable through the latch opening when the door is in the closed position; and a spill receptacle mounted within an interior space of the door between the outer and inner surfaces and sealed to the inner surface about the latch opening to thereby capture foreign items that enter the interior space of the door via the latch opening, said spill receptacle comprising a material that is effective to withstand a temperature of at least 750° F.

15. The cooking appliance of claim 14, further comprising an elongated latch rod having the hook member at one end extending generally radially away from a longitudinal axis of the latch rod, and an opposite end of the latch rod is rotatably driven by a motor.

16. The cooking appliance of claim 15, wherein the elongated latch rod comprises at least two separate rods that are connected to each other at a joint that permits said at least two separate rods to be angularly offset.

17. The cooking appliance of claim 16, wherein the joint is a universal joint.

18. The cooking appliance of claim 14, wherein the spill receptacle defines a compartment that is isolated from the interior space of the door and is sufficiently large to permit the hook member to rotate therein through an angle of at least 45° between locked and unlocked positions.

19. The cooking appliance of claim 18, wherein the compartment is defined by a plurality of side walls, a rear wall, and a front opening, and the hook member is insertable into the compartment through the front opening.

20. The cooking appliance of claim 19, wherein the spill receptacle comprises a flange extending about a periphery of the front opening that abuts the inner surface of the door, and a face surface of the flange comprises a face seal with a plurality of grooves configured to seal against the inner surface of the door.

21. The cooking appliance of claim 14, wherein an exterior surface of the spill receptacle comprises a plurality of projections extending outwards to engage a portion of the inner surface of the door.

22. The cooking appliance of claim 14, wherein the door comprises a bracket located within the interior space of the door, and an exterior surface of the spill receptacle comprises a slot to receive the bracket to mount the spill receptacle within the door.

23. The cooking appliance of claim 14, wherein the spill receptacle comprises a material that can be elastically deformed when mounted within the interior space of the door.

24. The cooking appliance of claim 14, wherein the cooking appliance further comprises a body-mounted hinge that interconnects a housing containing the oven cavity to the door and thereby pivotally supports the door for selectively opening and closing the oven cavity, and wherein the door further comprises a hollow mounting bracket and a hinge adapter configured to be securely mounted within the hollow mounting bracket to lockingly connect said body-mounted hinge to the hollow mounting bracket.

* * * * *